US006161901A

United States Patent [19]

Avner

[11] Patent Number: 6,161,901

[45] Date of Patent: Dec. 19, 2000

[54] FOLDABLE FURNITURE STRUCTURES AND SETS THEREOF

[76] Inventor: Dror Avner, 31 Fireberg, Tel Aviv 63827, Israel

[21] Appl. No.: 09/030,823

[22] Filed: Feb. 26, 1998

[51] Int. Cl.[7] ..... A47C 4/00

[52] U.S. Cl. ..... 297/440.12; 108/165; 248/174

[58] Field of Search ..... 297/440.1, 440.12, 297/440.13; 248/174; 108/165

[56] References Cited

U.S. PATENT DOCUMENTS

| | | | |
|---|---|---|---|
| 2,390,546 | 12/1945 | Mather | 108/115 |
| 3,126,140 | 3/1964 | Lizan et al. | 297/440.12 X |
| 3,149,880 | 9/1964 | Steuer . | |
| 3,178,227 | 4/1965 | Snyder . | |
| 3,295,890 | 1/1967 | Murdoch . | |
| 3,604,751 | 9/1971 | Caigan . | |
| 3,721,413 | 3/1973 | Robinson | 248/174 |
| 4,085,970 | 4/1978 | Klein . | |
| 4,223,945 | 9/1980 | Nikifits | 297/139 X |
| 4,229,038 | 10/1980 | Drost | 297/139 |
| 4,556,253 | 12/1985 | Geneve et al. . | |
| 4,648,658 | 3/1987 | Calco . | |
| 4,877,292 | 10/1989 | Volpe et al. . | |
| 4,970,831 | 11/1990 | Rots . | |
| 4,984,848 | 1/1991 | Scalisi et al. . | |
| 5,382,081 | 1/1995 | Henry . | |

FOREIGN PATENT DOCUMENTS

| | | | |
|---|---|---|---|
| 73 33198 | 5/1975 | France . | |
| 2505636 | 11/1982 | France | 297/440.12 |
| 1654 350 | 2/1971 | Germany . | |
| 2 279 556 | 7/1993 | United Kingdom . | |

*Primary Examiner*—Peter R. Brown
*Attorney, Agent, or Firm*—Mark M. Friedman

[57] ABSTRACT

A foldable furniture structure has a base which supports a load bearing sheet. The base is formed as a closed, foldable structure including two roughly parallel end sheets hingedly connected along corresponding edges by two sides, each of which is foldable along at least one intermediate vertical hinge. The base is thus foldable in a bellows-type motion between a closed state in which the two parallel end sheets are brought together with the sides folded between them, and an open state in which the two parallel end sheets are pulled apart. The load bearing sheet is hingedly attached to each of the upper edges of the two end sheets and has at least one intermediate hinge deployed parallel to the upper edges of end sheets. The dimension of load bearing sheet between the attachments to the upper edges of the end sheets is chosen to delimit a fully open configuration of the base such that the sides are opened to a bellows angle of no more than about 90°.

11 Claims, 7 Drawing Sheets fig.1
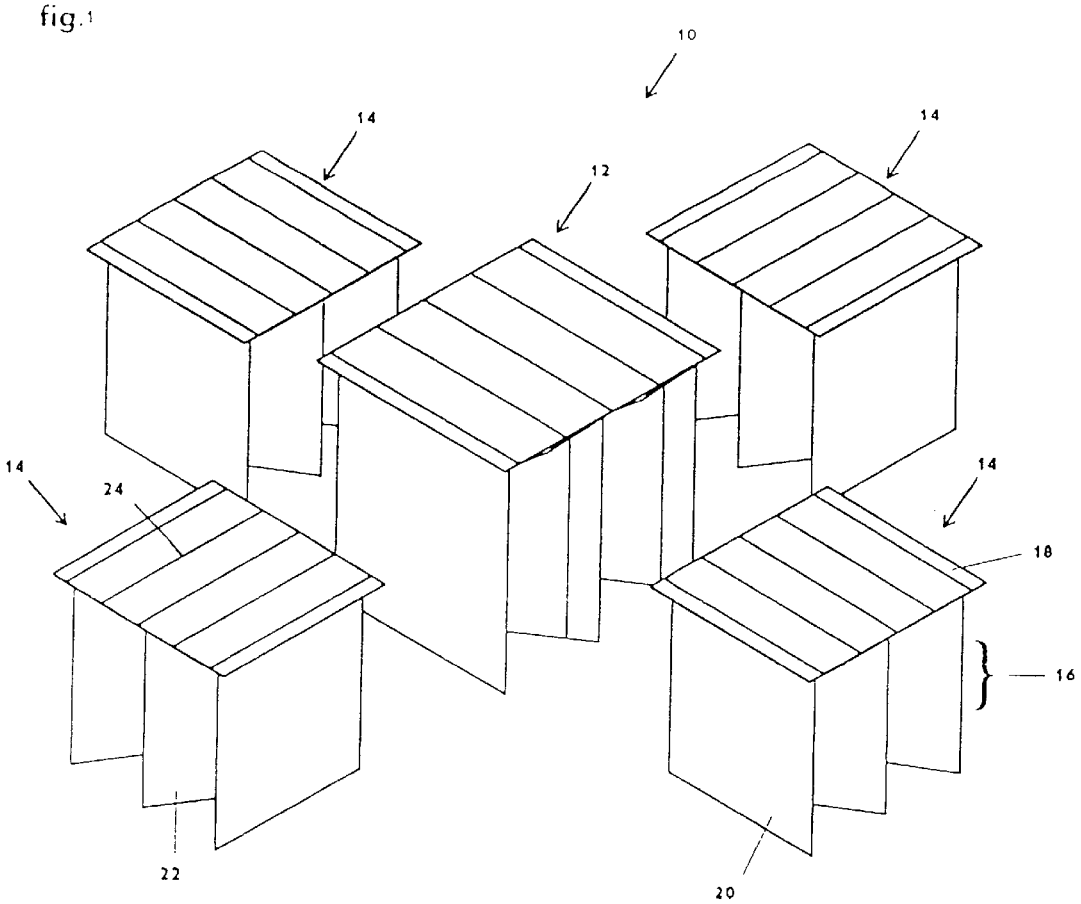
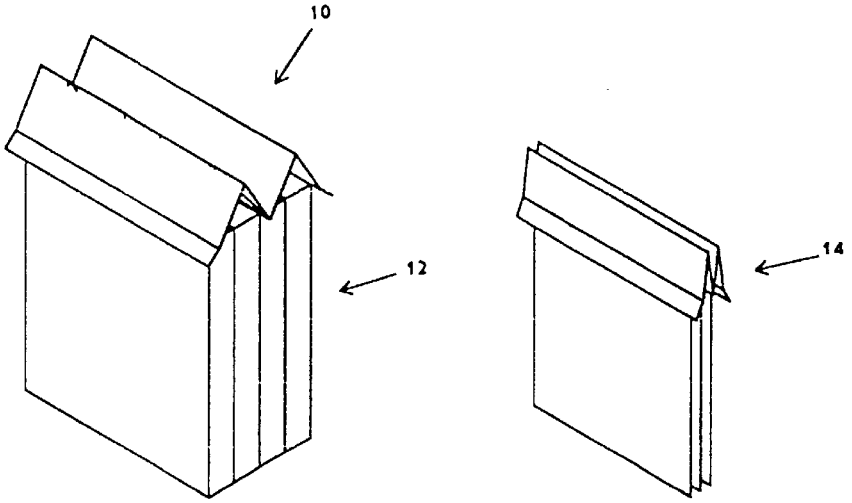
fig.2

FOLDABLE FURNITURE STRUCTURES AND SETS THEREOF

FIELD AND BACKGROUND OF THE INVENTION

The present invention relates to furniture and, in particular, it concerns a folding construction for load-bearing furniture, and sets of such furniture.

It is known to provide folding chairs to allow convenient storage of spare chairs and seasonal garden furniture. Such chairs are usually built as rigid substructures made of wood, plastic or tube-metal which are hinged together so as to collapse to a reduced size for storage.

Since the substructures of such folding chairs are made of intrinsically rigid load-bearing materials, they are typically quite heavy and bulky. This weight and bulk makes them inconvenient to handle and transport, even when folded.

In an attempt to address this problem, a number of foldable structures have been proposed made from flexible sheet material such as cardboard. Examples of such structures may be found in U.S. Pat. Nos. 3,149,880 to Steuer, 3,178,227 to Snyder, 3,295,890 to Murdoch, 3,604,751 to Caigan, 4,085,970 to Klein, 4,556,253 to Geneve et al., 4,648,658 to Calco, 4,877,292 to Volpe et al., 4,984,848 to Scalisi et al. and 5,382,081 to Henry, as well as in German Patent No. 1,654,350 to Raacke. However, opening and closing of these structures typically involves a complicated sequence of folding.

A further shortcoming of conventional folding furniture is that it does not generally stack or otherwise pack conveniently. As a result, although each item individually may be relatively compact, handling a set of such furniture is usually inconvenient.

There is therefore a need for highly compact, light-weight folding furniture structures which are easily opened and closed. It would also be highly advantageous to provide a set of such furniture in which a number of separate items can be nested within a single item for convenient handling.

SUMMARY OF THE INVENTION

The present invention is a folding construction for load-bearing furniture, and sets of such furniture.

According to the teachings of the present invention there is provided, a foldable furniture structure for supporting a load above a floor, the structure comprising: (a) a base formed as a closed, foldable structure including: (i) two substantially parallel end sheets, each having a lower edge for resting on the floor, an upper load-bearing edge, and first and second side edges, and (ii) a first side hingedly attached to both of the first side edges of the two end sheets, and a second side hingedly attached to both of the second side edges of the two end sheets, both the first and second sides being foldable along at least one intermediate vertical hinge, such that the base is foldable in a bellows-type motion between a closed state in which the two parallel end sheets are brought together with the first and second sides folded therebetween, and an open state in which the two parallel end sheets are pulled apart; and (b) a load bearing sheet hingedly attached to each of the upper edges of the two end sheets, the load bearing sheet being foldable along at least one intermediate hinge deployed parallel to the upper edges, a dimension of the load bearing sheet between the attachments to the upper edges being chosen to delimit a fully open configuration of the base such that the first and second sides are opened to a bellows angle of no more than about 90°.

According to a further feature of the present invention, there is also provided an intermediate vertical sheet positioned between and parallel to the two end sheets, wherein each of the first and second sides and the load bearing sheet are foldable along at least three intermediate hinges, one of the intermediate of each of the first and second sides and the load bearing sheet being hingedly connected to an edge of the intermediate vertical sheet.

According to a further feature of the present invention, the intermediate vertical sheet is configured to provide a lower edge positioned for resting on the floor.

According to a further feature of the present invention, the base and the load bearing sheet are formed from semi-flexible sheet material, the hinges being implemented as integral hinges.

According to a further feature of the present invention, the base and the load bearing sheet are formed from a unitary blank of semi-flexible sheet material, the hinges being implemented as integral hinges.

According to a further feature of the present invention, there is also provided a flexible sheet integrally formed with, but folded under, the load bearing sheet so as to reinforce the load bearing sheet near lines of contact with the first and second sides.

According to a further feature of the present invention, there is also provided at least one catch associated with the load bearing sheet and engagable with one of the first and second sides in the fully open configuration, the catch being formed to inhibit folding of the load bearing sheet so as to maintain the structure in the fully open configuration.

According to a further feature of the present invention, the catch is implemented as a flexible sheet integrally formed with, but folded under, the load bearing sheet, the catch being configured to fold into an inverted pyramid configuration.

There is also provided according to the teachings of the present invention, a nestable set of foldable furniture items, each furniture item supporting a load above a floor, the set comprising a table and at least one chair each including: (a) a base formed as a closed, foldable structure including: (i) two substantially parallel end sheets, each having a lower edge for resting on the floor, an upper load-bearing edge, and first and second side edges, and (ii) a first side hingedly attached to both of the first side edges of the two end sheets, and a second side hingedly attached to both of the second side edges of the two end sheets, both the first and second sides being foldable along at least one intermediate vertical hinge, such that the base is foldable in a bellows-type motion between a closed state in which the two parallel end sheets are brought together with the first and second sides folded therebetween, and to an open state in which the two parallel end sheets are pulled apart; and (b) a load bearing sheet hingedly attached to each of the upper edges of the two end sheets, the load bearing sheet being foldable along at least one intermediate hinge deployed parallel to the upper edges, a dimension of the load bearing sheet between the attachments to the upper edges being chosen to delimit a fully open configuration of the base, wherein dimensions of the table and of the at least one chair are chosen such that, in the closed state, the at least one chair can be stored nested within the table.

According to a further feature of the present invention, the first and second sides of the table are formed with at least one supplementary vertical hinge located proximal to one of the end sheets to provide an increased internal storage volume in the closed state.

There is also provided according to the teachings of the present invention, a foldable furniture structure for supporting a load above a floor, the structure comprising: (a) a base formed as a closed, foldable structure including: (i) two substantially parallel end sheets, each having a lower edge for resting on the floor, an upper load-bearing edge, and first and second side edges, and (ii) a first side hingedly attached to both of the first side edges of the two end sheets, and a second side hingedly attached to both of the second side edges of the two end sheets, both the first and second sides being foldable along at least three intermediate vertical hinges, such that the base is foldable in a bellows-type motion between a closed state in which the two parallel end sheets are brought together with the first and second sides folded therebetween, and an open state in which the two parallel end sheets are pulled apart; and (b) a load bearing sheet hingedly attached to each of the upper edges of the two end sheets, the load bearing sheet being foldable along at least three intermediate hinges deployed parallel to the upper edges, a dimension of the load bearing sheet between the attachments to the upper edges being chosen to delimit a fully open configuration of the base such that the first and second sides are opened to a bellows angle of no more than about 120°.

BRIEF DESCRIPTION OF THE DRAWINGS

The invention is herein described, by way of example only, with reference to the accompanying drawings, wherein:

FIG. 1 is an isometric view of a set of folding furniture, constructed and operative according to the teachings of the present invention, including a table and four chairs in their open state;

FIG. 2 is an isometric view of the set of furniture of FIG. 1 in its closed state with all but one of the chairs stored within the table;

DESCRIPTION OF THE PREFERRED EMBODIMENTS

The present invention is a folding construction for load-bearing furniture, and sets of such furniture.

The principles and operation of furniture according to the present invention may be better understood with reference to the drawings and the accompanying description.

Figure 3:
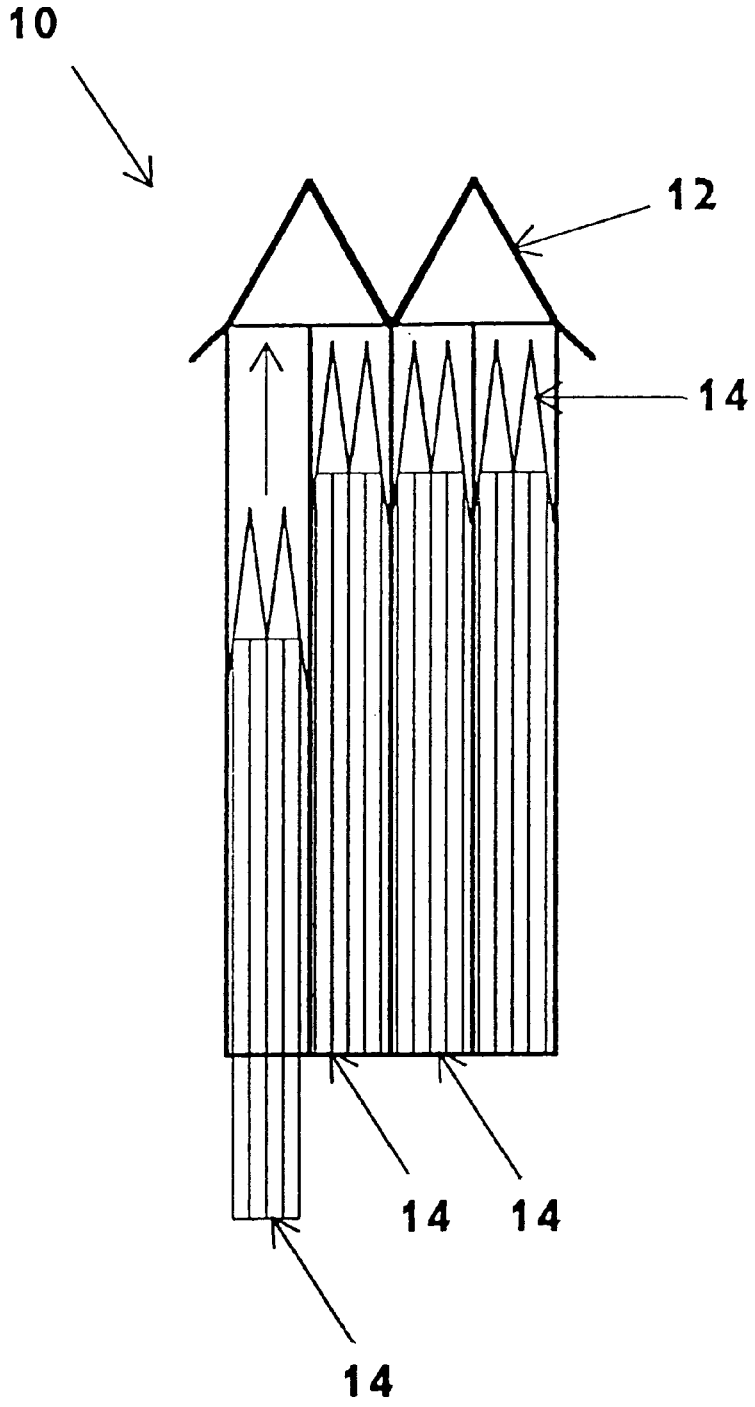
FIG. 3 is a cross-section through the stored set of FIG. 2 with the fourth chair partially inserted.

Referring now to the drawings, FIGS. 1–3 show a set of furniture, generally designated 10, constructed and operative according to the teachings of the present invention. Set 10 includes a table 12 and a number of chairs 14.

Generally speaking, each item of the set can be regarded as a base 16 which supports a load bearing sheet 18. Base 16 is formed as a closed, foldable structure including two substantially parallel end sheets 20 hingedly connected along corresponding edges by two sides 22, each of which is foldable along at least one intermediate vertical hinge. As a result of this structure, base 16 is foldable in a bellows-type motion between a closed state (FIGS. 2 and 3) in which the two parallel end sheets 20 are brought together with the sides 22 folded between them, and an open state (FIG. 1) in which the two parallel end sheets 20 are pulled apart. Load bearing sheet 18 is hingedly attached to each of the upper edges of the two end sheets 20 and has at least one intermediate hinge 24 deployed parallel to the upper edges of end sheets 20. The dimension of load bearing sheet 18 between the attachments to the upper edges of sheets 20 is chosen to delimit a fully open configuration of the base (FIG. 1) such that the sides are opened to a bellows angle of no more than about 90°.

The phrase "bellows-type motion" is used here to refer to roughly linear extension or contraction of a body which is achieved by simultaneous opposite rotation of connected wall segments in at least two opposite walls. The phrase "bellows angle" is used to refer to the smaller included angle between two adjacent segments of the wall. Thus, a fully stretched bellows which becomes a straight wall has a bellows angle of 180° whereas a completely closed bellows has an angle of 0°.

The dimensions of table 12 and chairs 14 are preferably chosen such that, in their closed states, chairs 14 can be stored nested within table 12 as shown in FIG. 3. Specifically, the maximum width of the load bearing sheet 18 of chairs 14 must be somewhat less than the width of end sheets 20 of table 12, and the total folded height of chairs 14 should be not much more than the height of end sheets 20 of table 12.

Figure 4:
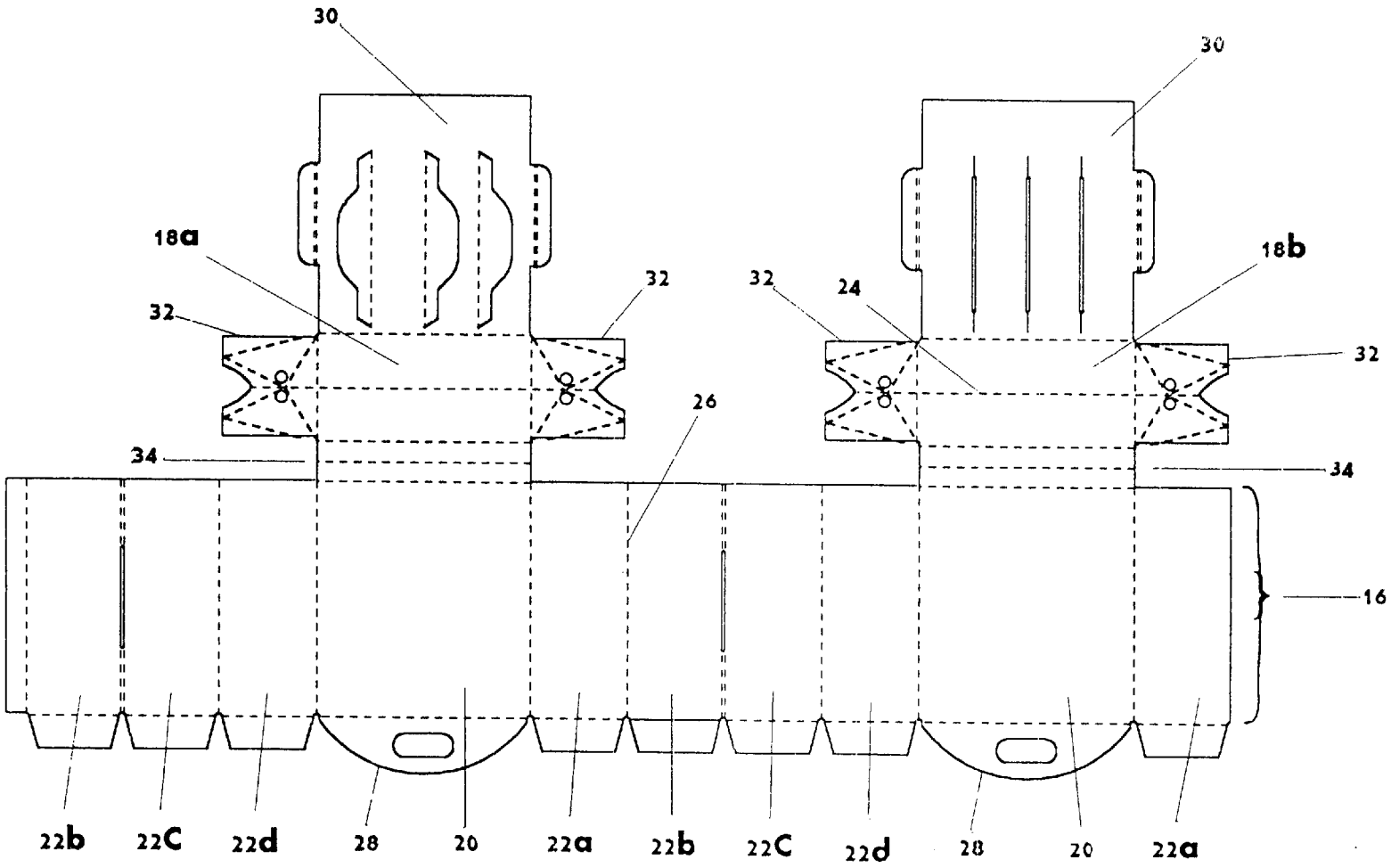
FIG. 4 is a plan view of a blank of flexible sheet material for constructing a chair from the set of FIG. 1.

Turning now to the features of chair 14 in more detail, FIG. 4 shows a blank from which chair 14 is constructed. For convenience of manufacture and assembly, the parts of the blank making up at least base 16 and typically all parts of the blank are preferably formed as a unitary blank of semi-flexible sheet material with hinges implemented as integral hinges. The blank may be made from any semi-flexible sheet material, i.e., material which is sufficiently flexible to form integral hinges but sufficiently rigid to withstand the required in-plane compressive loads without buckling. Suitable materials include, but are not limited to, natural or synthetic cardboard and various plastics. Clearly, the structures of the present invention may alternatively be implemented as a number of individual rigid elements connected by separate hinge elements.

The different parts of the blank are identified by the numerals used for the corresponding parts of the chair after it is constructed. Thus, the strip corresponding to base 16 is divided into two end sheets 20 and sides 22. In this preferred implementation, sides 22 are subdivided by three intermediate hinges 26 into four wall segments labeled 22*a*, 22*b*, 22*c* and 22*d*. Each segment is preferably at least about a third but no more than half the width of end sheets 20. Opposite ends of the blank are provided with tabs and corresponding slots or other suitable preparation to allow them to be hingedly fixed together to form the closed structure of base 16. The particular position of the connection, in this case between segments 22*a* and 22*b*, is not critical.

Preferably, the lower edges along the entirety of base 16 are provided with fold-over flaps 28. These serve a double purpose, both removing the tearable extremities of the sheet from the exposed edges and providing reinforcement in the region coming in contact with the floor. Optionally, flaps 28 associated with the lower edges of end sheets 20 may be shaped as a pair of carrying handles which can be opened out and used to carry chair 14 inverted in its closed state.

Turning now to load bearing surface 18, this is implemented here in two separate parts 18*a* and 18*b*, each featuring an intermediate hinge 24. Optionally, a double strip 34 between end sheets 20 and parts 18*a* and 18*b* may provide a marginal extension to load bearing surface 18. Attached to each part of load bearing surface 18*a* and 18*b* are sections of blank for forming an intermediate vertical sheet 30 (visible in FIG. 7) and catches 32 (to be described with reference to FIGS. 6 and 7 below).

Figure 5:
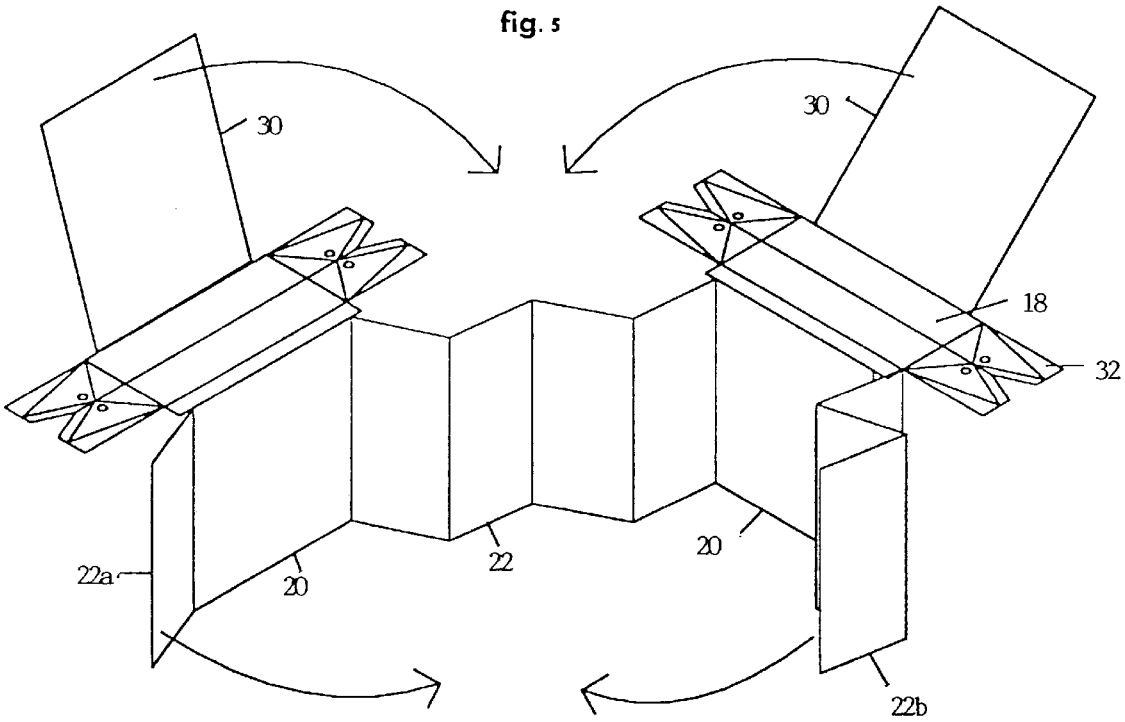
FIG. 5 is an isometric view of the blank of FIG. 4 partially folded.

FIG. 5 shows the initial stages of construction of chair 14 from the blank of FIG. 4. Intermediate vertical sheet sections 30 are folded inwards and downwards until they stand adjacent, positioned between and parallel to the two end sheets 20. They are then fixed together, preferably by oppositely-directed tabs which engage slots shown in FIG. 4. If a double strip 34 is provided, the two layers are fixed together by suitable methods such as gluing. Catch sections 32 are folded underneath load bearing surface 18 and the ends of the blank are fixed together to form closed base 16. Preferably, the edges of intermediate vertical sheet 30 are also hingedly attached, for example by tabs glued into engagement slots, to the intermediate hinges 26 between wall segments 22*b* and 22*c*. At this point, chair 14 is complete and functional.

The primary function of intermediate vertical sheet 30 is to provide rigidity and twist resistance to the structure by fixing the centerline of load bearing sheet 20 relative to sides 22. In a preferred implementation as illustrated here, intermediate vertical sheet 30 is made a similar size to end sheets 20 so that it also provides a lower edge for resting on the floor. In this case, intermediate vertical sheet 30 gives valuable additional support to load bearing surface 18.

At this point, the basic operation of chair 14 should already be clear. Referring back to FIGS. 1 and 2, the three effective intermediate folds of both sides 22 and load bearing sheet 18 allow bellows-type closing of the chair with sides 22 folding inwards and sheet 18 folding upwards to the closed state of FIG. 2. When the process is reversed, sides 22 and load bearing sheet 18 open until sheet 18 reaches its fully extended flat state. This prevents any further opening of chair 14. The ratio of the length of sides 22 to the dimension of sheet 18 between its lines of attachment to end sheets 20 is chosen such that sides 22 assume a folded configuration with a bellows angle of no more than about 120°, preferably no more than about 90°, and typically between about 60° and about 80°, so as to provide effective support to load bearing sheet 18.

In order to avoid risk of chair 14 closing while in use, a catch feature is preferably provided to maintain chair 14 in its fully open configuration. This may be achieved by a catch associated with load bearing sheet 18 and engagable with one of sides 22 when in the fully open configuration so as to inhibit folding of the load bearing sheet. One possible implementation of a catch feature will now be described in detail with reference to FIGS. 6 and 7.

Figure 6A:
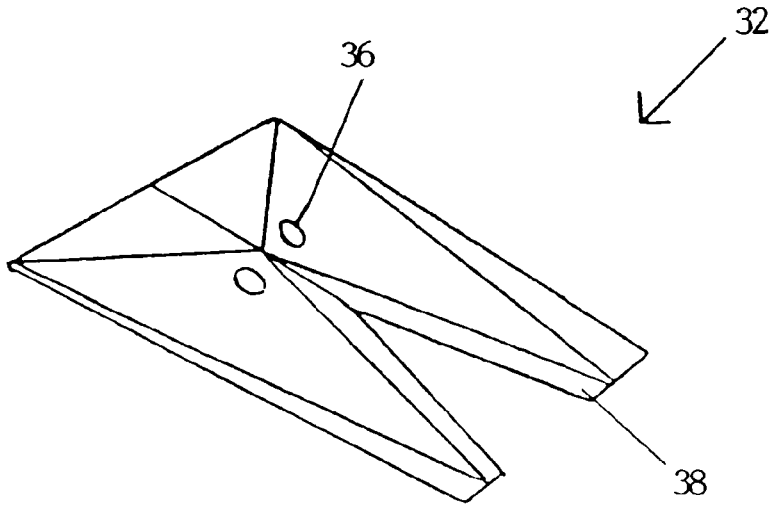
FIG. 6A is a detailed isometric view taken from below of a catch feature of the blank of FIG. 4 showing the catch deployed in its inoperative configuration.
Figure 6B:
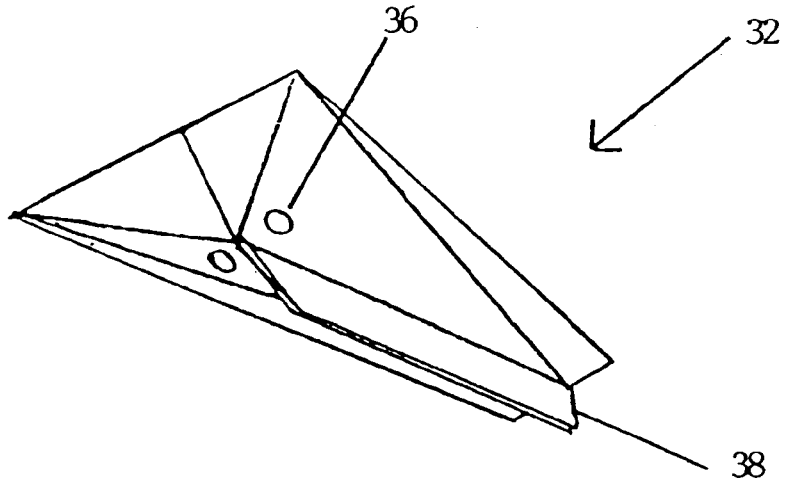
FIG. 6B is a view similar to FIG. 6A showing the catch deployed in its operative configuration.
Figure 7:
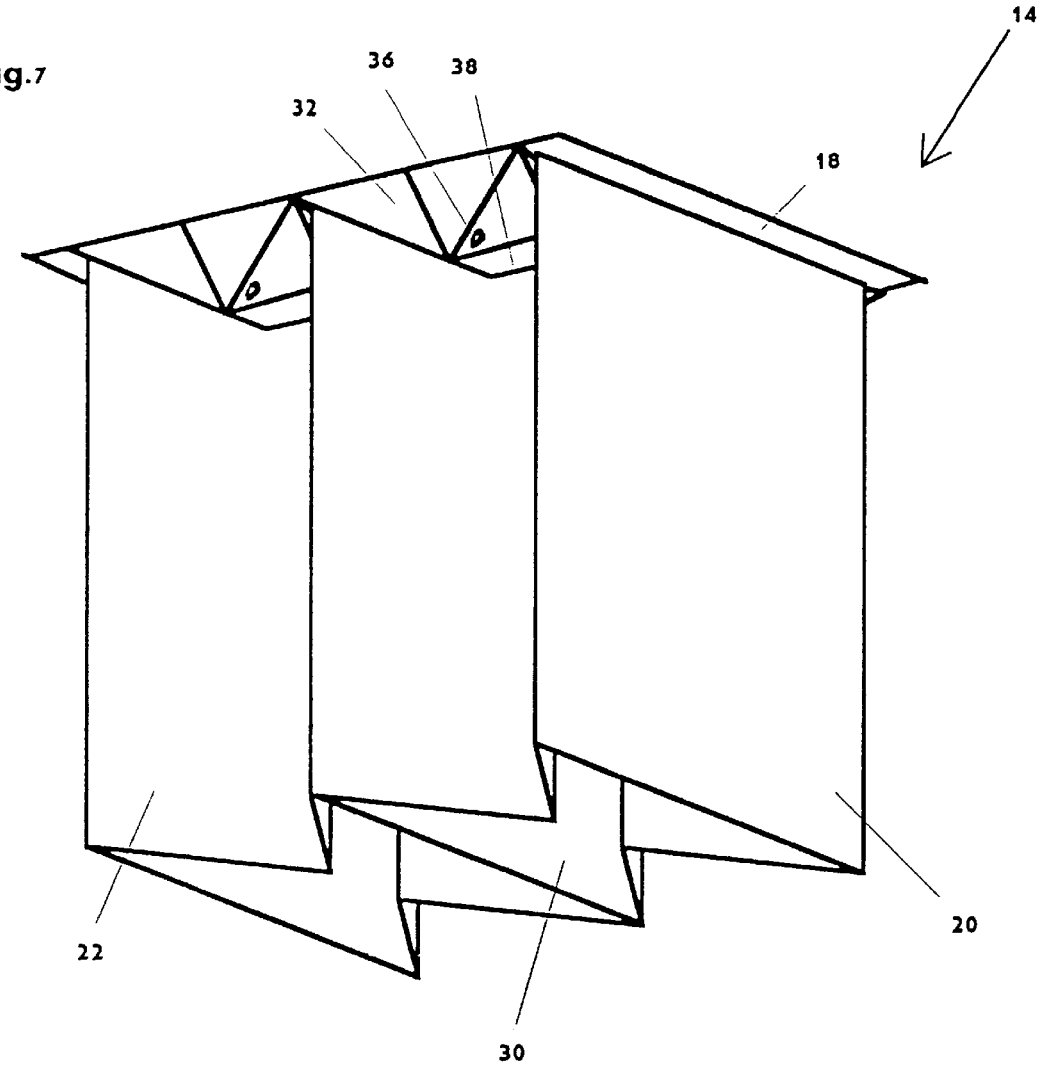
FIG. 7 is an isometric view taken from below of a chair from the set of FIG. 1 showing the catch in use.

FIG. 6A shows catch 32 of FIGS. 4 and 5 in more detail. In its planar state as shown, catch 32 folds freely along lines corresponding to intermediate hinges 24 as chair 14 opens and closes. When chair 14 is fully open so that load bearing sheet 18 and catch 32 are flat, the catch can be operated by pulling downwards and outwards on two finger-grip holes 36. This converts catch 32 to the locked state of FIG. 6B. Here, the catch is folded into an inverted pyramid configuration, thus becoming resistant to folding. A downward extending flange 38 of the catch in its locked state is shaped to lodge against the upper part of side 22 as shown in FIG. 7, thereby maintaining the inverted pyramid configuration.

Parenthetically, it should be noted that the presence of the fold-over extensions of load bearing sheet 18 making up catches 32 serve an additional or alternative function independent of their design as catches; the double thickness generated by these folded-over portions provides valuable reinforcement to load bearing sheet 18 along lines of contact where it rests on the upper edges of sides 22.

Figure 8:
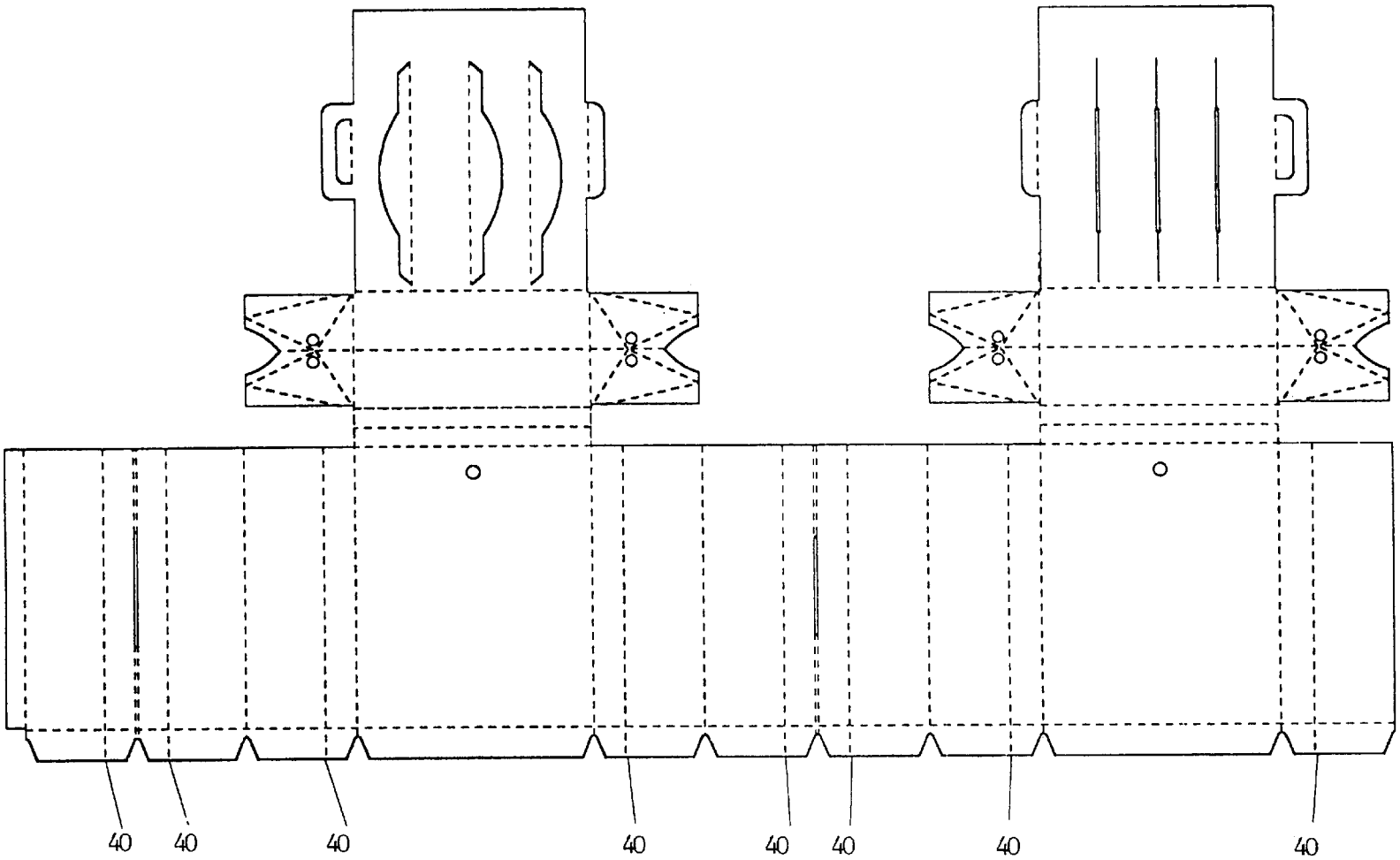
FIG. 8 is a plan view of a blank of flexible sheet material for constructing the table from the set of FIG. 1.

Finally, turning to FIG. 8, it should be noted that the structure of table 12 is essentially similar to that of chairs 14 and can be understood from the above description. In addition to the differing dimensions described above, table 12 preferably also differs from chairs 14 by the provision of at least one supplementary vertical hinge 40 on each side 22 located near to end sheet 20. This provides sufficient articulation of sides 22 to provide an increased internal storage volume within table 12 in the closed state.

It will be appreciated that the above descriptions are intended only to serve as examples, and that many other embodiments are possible within the spirit and the scope of the present invention.

What is claimed is:

1. A foldable furniture structure for supporting a load above a floor, the structure comprising:

(a) a base formed as a closed, foldable structure including:

(i) two substantially parallel end sheets, each having a lower edge for resting on the floor, an upper load-bearing edge, and first and second side edges, and (ii) a first side hingdely attached to both of said first side edges of said two end sheets, and a second side hingedly attached to both of said second side edges of said two end sheets, both said first and second sides being foldable along at least three intermediate vertical hinges, such that said base is foldable in a bellows-type motion between a closed state in which said two parallel end sheets are brought together with said first and second sides folded therebetween, and an open state in which said two parallel end sheets are pulled apart;

(b) a load bearing sheet hingedly attached to each of said upper edges of said two end sheets, said load bearing sheet being foldable along at least one intermediate hinge deployed parallel to said upper edges, a dimension of said load bearing sheet between said attachments to said upper edges being chosen to delimit a fully open configuration of said base such that said first and second sides are opened to a bellows angle of no more than about 90°; and (c) an intermediate vertical sheet positioned between and parallel to said two end sheets, said intermediate vertical sheet being hingedly connected to one of said at least three intermediate hinges of each of said first and second sides and to said load bearing sheet said intermediate vertical sheet being configured to provide a lower edge positioned for resting on the floor.

2. The foldable furniture structure of claim 1, wherein said base and said load bearing sheet are formed from semi-flexible sheet material, said hinges being implemented as integral hinges.

3. The foldable furniture structure of claim 1, wherein said base and said load bearing sheet are formed from a unitary blank of semi-flexible sheet material, said hinges being implemented as integral hinges.

4. The foldable furniture structure of claim 1, further comprising a flexible sheet integrally formed with, but folded under, said load bearing sheet so as to reinforce said load bearing sheet near lines of contact with said first and second sides.

5. The foldable furniture structure of claim 1, further comprising at least one catch associated with said load bearing sheet and engagable with one of said first and second sides in said fully open configuration, said catch being formed to inhibit folding of said load bearing sheet so as to maintain the structure in said fully open configuration.

6. The foldable furniture structure of claim 5, wherein said catch is implemented as a flexible sheet integrally formed with, but folded under, said load bearing sheet, said catch being configured to fold into an inverted pyramid configuration.

7. A nestable set of foldable furniture items, each furniture item supporting a load above a floor, the set comprising a table and at least one chair each including:

(a) a base formed as a closed, foldable structure including:

(i) two substantially parallel end sheets, each having a lower edge for resting on the floor, an upper load-bearing edge, and first and second side edges, and (ii) a first side hingedly attached to both of said first side edges of said two end sheets, and a second side hingedly attached to both of said second side edges of said two end sheets, both said first and second sides being foldable along at least one intermediate vertical hinge, such that said base is foldable in a bellows-type motion between a closed state in which said two parallel end sheets are brought together with said first and second sides folded therebetween, and to an open state in which said two parallel end sheets are pulled apart; and (b) a load bearing sheet hingedly attached to each of said upper edges of said two end sheets, said load bearing sheet being foldable along at least one intermediate hinge deployed parallel to said upper edges, a dimension of said load bearing sheet between said attachments to said upper edges being chosen to delimit a fully open configuration of said base, wherein dimensions of said table and of said at least one chair are chosen such that, in said closed state, said at least one chair can be stored nested within said table, and wherein said first and second sides of said table are formed with at least one supplementary vertical hinge located proximal to one of said end sheets to provide an increased internal storage volume in said closed state.

8. A foldable furniture structure for supporting a load above a floor, the structure comprising:

(a) a base formed as a closed, foldable structure including:

(i) two substantially parallel end sheets, each having a lower edge for resting on the floor, an upper load-bearing edge, and first and second side edges, and (ii) a first side hingedly attached to both of said first side edges of said two end sheets, and a second side hingedly attached to both of said second side edges of said two end sheets, both said first and second sides being foldable along at least three intermediate vertical hinges, such that said base is foldable in a bellows-type motion between a closed state in which said two parallel end sheets are brought together with said first and second sides folded therebetween, and an open state in which said two parallel end sheets are pulled apart; and (b) a load bearing sheet hingedly attached to each of said upper edges of said two end sheets, said load bearing sheet being foldable along at least three intermediate hinges deployed parallel to said upper edges, a dimension of said load bearing sheet between said attachments to said upper edges being chosen to delimit a fully open configuration of said base such that said first and second sides are opened to a bellows angle of no more than about 120°.

9. The foldable furniture structure of claim 8, wherein each of said two end sheets is configured to provide a carrying handle near said lower edge.

10. The foldable furniture structure of claim 9, wherein each of two end sheets features a flap hingedly associated with said lower edge, each of said carrying handles being formed by one of said flaps.

11. A foldable furniture structure for supporting a load above a floor, the structure comprising:

(a) a base formed as a closed, foldable structure including:

(i) two substantially parallel end sheets, each having a lower edge for resting on the floor, an upper load-bearing edge, and first and second side edges, and (ii) a first side hingedly attached to both of said first side edges of said two end sheets, and a second side hingedly attached to both of said second side edges of said two end sheets, both said first and second sides being foldable along at least three intermediate vertical hinges, such that said base is foldable in a bellows-type motion between a closed state in which said two parallel end sheets are brought together with said first and second sides folded therebetween, and an open state in which said two parallel end sheets are pulled apart;

(b) a load bearing sheet hingedly attached to each of said upper edges of said two end sheets, said load bearing sheet being foldable along at least one intermediate binge deployed parallel to said upper edges, a dimension of said load bearing sheet between said attachments to said upper edges being chosen to delimit a fully open configuration of said base such that said first and second sides are opened to a bellows angle of no more than about 90°; and (c) at least one catch implemented as a flexible sheet integrally formed with, but folded under, said load bearing sheet and engagable with one of said first and second sides in said filly open configuration said catch being configured to fold into an inverted pyramid configuration formed to inhibit folding said load bearing sheet so as to maintain the structure in said fully open configuration.

* * * * *